United States Patent [19]

Solheim

[11] Patent Number: 4,600,100

[45] Date of Patent: Jul. 15, 1986

[54] THROAT STRUCTURE FOR GOLF CLUB BAGS

[76] Inventor: John A. Solheim, 529 W. Wakonda La., Phoenix, Ariz. 85023

[21] Appl. No.: 684,102

[22] Filed: Dec. 10, 1984

Related U.S. Application Data

[63] Continuation-in-part of Ser. No. 587,453, Mar. 8, 1984.

[51] Int. Cl.[4] ..... A63B 55/00

[52] U.S. Cl. ..... 206/315.6; 206/315.3

[58] Field of Search ..... 206/315.2–315.8; 248/96; 211/70.2; 280/DIG. 6

[56] References Cited

U.S. PATENT DOCUMENTS

| | | | |
|---|---|---|---|
| 1,271,784 | 7/1918 | Simpson | 206/315.6 |
| 1,621,107 | 3/1927 | Cross | 206/315.6 |
| 1,902,644 | 3/1933 | Hotze | 206/315.8 |
| 1,951,158 | 3/1934 | Locke et al. | 206/315.5 |
| 1,956,008 | 4/1934 | Deibel | 206/315.6 |
| 2,282,842 | 5/1942 | Abell | 206/315.7 X |
| 2,502,627 | 4/1950 | Martin | 206/315.6 |
| 2,629,609 | 2/1953 | Wilson | 206/315.5 X |
| 3,331,419 | 7/1967 | Bencriscutto | 206/315.6 |

FOREIGN PATENT DOCUMENTS

| | | | |
|---|---|---|---|
| 207317 | 11/1923 | United Kingdom | 206/315.5 |

*Primary Examiner*—William Price
*Assistant Examiner*—Sue A. Weaver
*Attorney, Agent, or Firm*—Herbert E. Haynes, Jr.

[57] ABSTRACT

A throat structure for use in the open top of a golf bag includes the combination of a ring-shaped body with a special trifurcated divider therein which separates the opening into the golf bag into three golf club segregation areas. The trifurcated divider has three divider bars extending radially from an interconnecting junction with each adjacent pair of the divider bars defining an obtuse included angle so that the golf clubs containable in the segregation areas will tend to collect in predetermined widely separated areas when the golf bag is being carried to facilitate club selection and removal characteristics and to minimize golf club entanglement. The throat structure is also preferably formed in a special manner which provides inwardly facing curved surfaces to improve golf club extraction characteristics by elimination of sharp edges upon which the golf clubs can catch when being extracted from the golf bag.

19 Claims, 9 Drawing Figures

THROAT STRUCTURE FOR GOLF CLUB BAGS

CROSS REFERENCE TO RELATED APPLICATION

This application is a continuation-in-part of a copending prior U.S. application Ser. No. 587,453, filed Mar. 8, 1984, for an Improved Throat Structure for Golf Club Bags, by the same inventor.

BACKGROUND OF THE INVENTION

1. Field of the Invention

This invention relates generally to bags for carrying golf clubs and more particularly to an improved throat structure for facilitating placement and removal of the golf clubs in the bag and providing improved golf club group segregation.

2. Description of the Prior Art

Golf clubs have been stored, carried, and otherwise transported in especially designed golf bags for many years. Most golf bags are in the form of a tubular fabric container generally of cylindrical configuration having a closed bottom and an open top, or throat, through which the golf clubs are inserted into and removed from the bag. When golf clubs are in such bags, the grips of the clubs are in resting engagement with the closed bottom of the bag, and the heads of the clubs extend more or less axially from the open throat of the bag. By positioning the golf clubs in the bag in this manner, the clubs can be identified for club selection purposes by a golfer in that the configurations of the heads vary in accordance with the intended usage and are for the most part generally provided with suitable identifying indicia.

Although the number of golf clubs carried in golf bags will vary, the rules of golf dictate that the maximum number of clubs carried while playing will be fourteen. From this, it will be appreciated that even though the clubs vary in configuration and are provided with identifying indicia, selecting a desired club from the relatively large number of clubs can be distracting and sometimes frustrating. And, after the desired club has been identified, removal of the club is not always easy in that the clubs can, and often do, become entangled in the bag.

For the above reasons, most golf bags are provided with throat structures which separate the clubs into segregated groupings which are, of course, determined by individual preference. For example, the woods are usually segregated by the throat structure of the golf bag into one group, the low number, or long and middle distance irons into another group, and the higher number, or shorter distance irons, and the putter into a third group.

The open top, or throat structure of most prior art golf bags are usually in the form of a substantially circular ring-shaped body having a spaced pair of linear dividers placed therein so that the dividers form equal chords within the circular ring-shaped body. The dividers are usually tubular structures formed by folding a relatively heavy gage, usually synthetic, leather-like material, and stitching the aligned longitudinal edges together. Such dividers are normally mounted in the ring-shaped body by an elongated strap which is threadingly passed through the tubular dividers and through suitable openings in the body with a buckle being used to secure the strap, and thus the dividers in place.

Throat structures which are divided as described above are commonly used in the variously sized golf bags from the relatively small diameter light weight golf bags to the relatively large diameter heavy golf bags. In any event, this divider configuration provides three approximately equally sized open areas and most golfers place their woods, usually three or four, in one area, their putter and three or so short distance irons in another area, with the central area being used for containment of the middle and long distance irons. While these three open areas are a considerable improvement over a non-divided throat structure with regard to segregation and ease of club removal, the club entanglement problem is still quite bad particularly with regard to the central opening which can contain as many as seven or eight clubs if the golfer divides the clubs in the usual manner as described above.

In some golf bags, a third divider is sometimes employed to further provide the throat structure with an additional number of club separating open areas. The third divider is formed in the same manner as described above and is mounted below the other two dividers and lies on a diameter of the ring-shaped body and is transverse with respect to the other two dividers. Therefore, the third divider will provide six separate openings through the ring-shaped body. In yet another prior art golf bag, the throat structure is divided into four open golf club segregation areas which are formed by providing the two linear dividers in the ring-shaped body, in the same manner as the first hereinbefore described throat structure, and interconnecting them with a cross rib at the centers thereof. This divides the central opening into two equal halves. These two prior art golf bag throat structures, i.e., those having six open club segregation areas and those with four, are limited for use in the relatively larger diameter golf bags in that if used in the relatively smaller golf bags, the size of the open areas are too small and this hampers facile insertion and removal of the golf clubs. Therefore, the first hereinbefore described three-open area golf bag throat structure is by far the most practical prior art configuration for use in the relatively small diameter light weight golf bags.

In all of the prior art golf bag structures known to me, a particular problem, or shortcoming exists, and the first previously discussed three-open area prior art golf bag structure will be employed in describing this problem.

As is well known, when a golf bag is carried it will normally be disposed at an angle relative to the ground with the throat structure of the bag lying in a more or less upwardly facing angular attitude. Therefore, the open golf club group segregation areas provided in the golf bag throat structure may be defined as including an upper opening, an intermediate opening, and a lower opening. The lower portions of the upper and intermediate openings are defined by linear dividers and when a golf bag is being carried those linear dividers lie in a substantially horizontal attitude, with the shafts of the clubs resting thereon.

However, in actuality, the dividers will slope at a relatively small acute angle with the horizontal due to the golf bag being in bearing engagement with the carrier's body and being suspended by the shoulder strap. This results in the golf clubs tending to collect in one corner or the other of their respective segregated openings. This will not happen in the lower compartment in that the bottom portion thereof is defined by an arcuate part of the ring-shaped body. When the golf clubs gather in the corners as described above, the golf clubs in the upper and intermediate openings will gather in adjacent corners of their respective openings, and this causes shifting and uneven weight distribution in the golf bag. However, a more troublesome problem results from the heads of the golf clubs becoming entangled, making individual club identification and extraction more difficult.

Another problem with all of the above described prior art golf bag throat structures is that of the golf clubs hanging-up, or catching in the throat structures as the clubs are being extracted from the golf bag. The grips provided on the golf clubs are, by necessity, of larger diameters than the shafts of the clubs. Therefore, the grips present an annular lip which faces upwardly toward the throat structure when the golf clubs are in the golf bag, and, the golf club grips are tapered so that they gradually increase in diameter from the annular lips to the terminal ends thereof. A large part of the catching problem occurs when the annular lip of the golf club grips catches on the downwardly facing edges of the dividers of the throat structures, and further catching occurs at the corners of the open club segregation areas where the dividers intersect with the ring-shaped body. When two or more golf clubs are simultaneously extracted, the aligned grip can become wedged between the parallel divider bars.

Therefore, a need exists for a new and improved golf bag throat structure which is ideally suited for use in relatively small diameter golf club carrying bags which overcomes some of the problems and shortcomings of the prior art.

SUMMARY OF THE INVENTION

In accordance with the present invention, a new and improved golf bag throat structure is disclosed which is ideally suited for use in relatively small diameter light weight golf bags and which has improved golf club segregation properties and improved golf club insertion and extraction characteristics.

The improved golf club throat structure includes a ring-shaped body having a trifurcated divider means therein which provides three especially configured open golf club segregation areas in the throat. The trifurcated divider means includes three divider bars which extend radially from an interconnecting junction with each adjacent pair of divider bars defining an obtuse included angle. When the throat structure is mounted in a golf bag which is disposed in the hereinbefore described carrying attitude, a first one of the divider bars extends substantially vertically from the junction to the ring-shaped body to bisect the upper part of the ring-shaped body and thereby provide an opposed pair of open upper golf club segregation areas. The second and third divider bars extend angularly downwardly and oppositely from the junction to close the bottoms of the upper segregation areas and to define the top of a centrally located bottom open golf club segregation area, the bottom of which is defined by an arcuate portion of the ring-shaped body. Each of the opposed pair of upper club segregation areas are bounded by the substantially vertical divider bar on their inner sides and by arcuate portions of the ring-shaped body on their outer sides. The downwardly and oppositely sloping second and third divider bars, which close the bottoms of the pair of upper club segregation areas, will cause the golf clubs that are grouped in those areas to inherently gather at opposite sides of the ring-shaped body at the lowermost outwardly disposed corners of their respective segregation areas when the golf bag is in the carried attitude. In that the centrally located bottom segregation area is closed along its bottom by the arcuate portion of the ring-shaped body, the golf clubs grouped therein will tend to be concentrated in the center at the bottom of the ring-shaped body.

In view of the above, it will be seen that the above described trifurcated divider means will separate the groups of golf clubs as far apart from each other as is possible within the confines of the ring-shaped body, and will tend to hold the separated groupings in the widely separated locations, thus eliminating, or at least minimizing the prior art weight shifting problem and the head entanglement problem resulting from the different club groupings gathering in adjacent corners of their respective open segregation areas.

The problem with golf clubs catching in the prior art golf bag throat structures when the clubs are being extracted therefrom is eased in the throat structure of the present invention by providing relatively large radii in the corners of the open areas, and the radii are sized to be at least approximately equal to the radius of the large end of golf club grips. The catching problem is further eased by providing means on the inwardly facing surfaces of the trifurcated divider means, and on the ring-shaped body to eliminate any edges upon which the annular lips of the golf club grips could catch when the clubs are extracted from the golf bags. The prior art problem with simultaneously extracted multiple golf clubs becoming wedged between parallel divider bars does not occur in the throat structure of the present invention due to the angular relationships of the divider bars.

In a first, and preferred embodiment of the golf bag throat structure of the present invention, the ring-shaped body and the trifurcated divider means are molded, or otherwise formed as a unitary structure from a suitable synthetic resin. In a second embodiment, the trifurcated divider means and the ring-shaped body are separated pieces which are assembled, in various manners, during fabrication of the golf bags.

Accordingly, it is an object of the present invention to provide a new and improved open top, or throat structure for use in golf bags.

Another object of the present invention is to provide a new and improved golf bag throat structure which is configured to provide improved golf club group segregation characteristics and has improved golf club extraction properties.

Another object of the present invention is to provide a new and improved golf bag throat structure which is ideally suited for use in relatively small diameter light weight golf bags with the throat structure including a ring-shaped body having a trifurcated divider means therein which provides three especially configured open and separated areas which inherently keeps the golf club groupings in widely spaced locations during carrying of the golf club bag.

Another object of the present invention is to provide a new and improved golf bag throat structure of the above described character wherein the trifurcated divider means includes three divider bars which extend radially from an interconnecting junction to the ring-shaped body to provide the three open and separated golf club group segregation areas.

Another object of the present invention is to provide a new and improved golf bag throat structure of the above described character wherein each adjacent pair of the three divider bars of the trifurcated divider means defines an obtuse included angle with the trifurcated divider means and the ring-shaped body oriented in a golf bag that is in the carrying attitude to provide a pair of open upper golf club group segregation areas on opposite sides of a substantially vertical first divider bar, with the third golf club group open segregation area below the second and third divider bars.

Another object of the present invention is to provide a new and improved golf bag throat structure of the above described type wherein the second and third divider bars of the trifurcated divider means each define the bottom of a different one of the pair of open upper golf club group segregation areas when the golf bag is in the carrying attitude, and they slope outwardly and downwardly from the junction so that the golf club groupings carried in the upper segregation areas will inherently tend to gather at the lowermost outwardly disposed corners of their respective upper segregation areas.

Still another object of the present invention is to provide a new and improved golf bag throat structure of the above described character wherein the corners of each of the three open and separated golf club segregation areas are formed with radii which are at least substantially equal to the largest radius provided on a golf club grip to minimize golf club hang up, or catching in those corners of the structure when the clubs are being extracted from the golf bag.

Yet another object of the present invention is to provide a new and improved golf bag throat structure of the above described character and further including means for eliminating the downwardly facing edges of the throat structure to prevent the annular lip of the golf club grips from catching on such edges when the golf clubs are being extracted from the golf bag.

The foregoing and other objects of the present invention as well as the invention itself, may be more fully understood from the following description when read in conjunction with the accompanying drawings.

DESCRIPTION OF THE PREFERRED EMBODIMENTS

Figure 1:
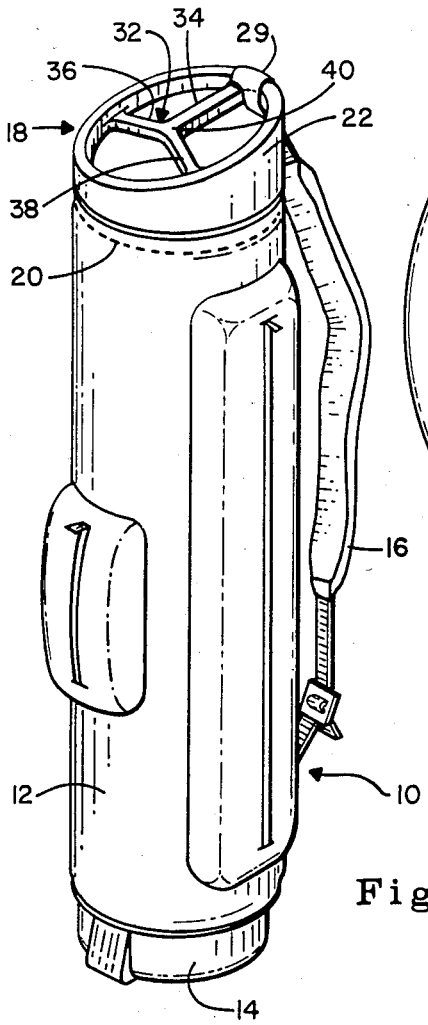
FIG. 1 is a perspective view of a typical golf bag which is provided with the throat structure of the present invention.

Referring more particularly to the drawings, FIG. 1 shows a typical type of golf bag structure which is identified in its entirety by the reference numeral 10. As is customary, the bag 10 includes a tubular container body 12 which, in light weight and relatively small diameter golf bags, such as the one shown in FIG. 1, is usually formed of a suitable synthetic material, such as nylon. The bag 10 further includes a bottom closure member 14 which is a cup-shaped rigid structure that is stitched or otherwise fastened in the bottom of the tubular body 12. A suitable carrying strap 16 is also provided as is customary.

As will hereinafter be described in detail, the golf bag 10 is provided with an especially configured open top, or throat structure 18, which is suitably mounted in the top of the tubular container body 12 such as by sewing as identified at 20 in FIG. 1.

Figure 2:
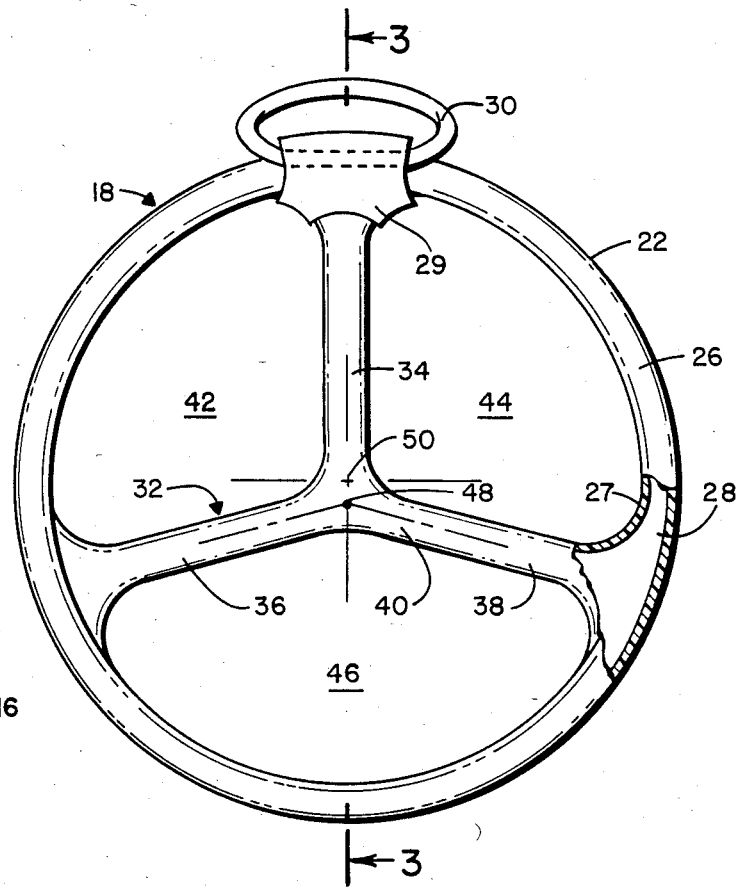
FIG. 2 is an enlarged plan view of a first embodiment of the golf bag throat structure of the present invention showing the various features thereof.
Figure 3:
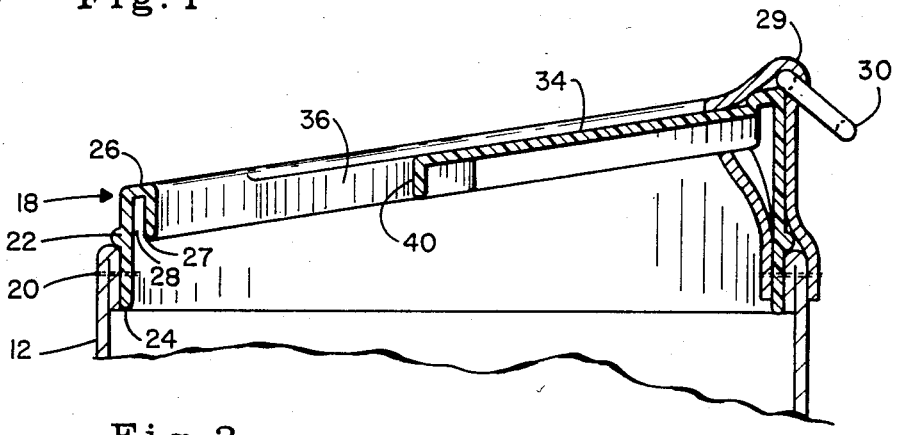
FIG. 3 is a sectional view taken along the line 3—3 of FIG. 2.

As seen best in FIGS. 2 and 3, the throat structure 18 includes a ring-shaped body 22 of substantially cylindrical configuration, with the lower, or inner edge 24 lying in a plane transverse to the axis of the body and an upper, or outer edge 26 which is rolled over as shown to provide an inwardly spaced lip 27 which is concentric with the body 22 with a downwardly opening annular groove 28 therebetween. The outer edge 26 lies in a plane which is angularly disposed with respect to the axis of the body 22. This angular orientation of the upper edge 26 or the known alternative of an axially offset two-tier, or stepped upper edge (not shown) of the ring-shaped body is well known in the art and is employed for access and bag balancing purposes.

As shown, the carrying strap 16 is attached to the highest point on the ring-shaped body 22. This is done for the above mentioned bag balancing purposes and the strap 16 may be attached in various ways, such as by means of a suitable flap 29 which is looped over the ring-shaped body 22 and is suitably secured thereto so as to captively retain a metallic ring 30 to which the strap 16 is demountably attached such as by means of a suitable clip (not shown).

The throat structure 18 further includes a trifurcated divider means 32 which, in this first embodiment of the present invention, is molded or otherwise integrally formed with the ring-shaped body 22. The trifurcated divider means 32 includes first, second and third divider bars 34, 36 and 38, respectively, which extend radially ly from an interconnecting junction 40 to the inwardly spaced lip 27 of the ring-shaped body 22. The divider bars 34, 36 and 38 are arranged in the bore of the ring-shaped body 22 to divide the bore into three open golf club group segregation areas 42, 44 and 46. The trifurcated divider means is formed so that each adjacent pair of the divider bars 34, 36 and 38 define an obtuse included angle. In other words, the included angles between the divider bars 34 and 36, between the divider bars 36 and 38, and between the divider bars 38 and 34 are all obtuse. However, it is preferred that the included angle between the divider bars 36 and 38 be larger than the included angles between the divider bars 34, 36 and 34, 38 as will hereinafter be described.

When a golf bag is being carried by means of the shoulder strap 16, it will normally be oriented so that the first divider bar 34 will extend substantially upwardly from the junction 40 toward what may be defined as the top portion of the ring-shaped body. Thus, the two open areas 42 and 44 will be in the upper part of the bore of the ring-shaped body 22, and the open area 46 will be adjacent what may be defined as the bottom portion of the ring-shaped body in the bottom part of the bore thereof. Such orientation is seen best in FIG. 2, and as a result of this, the golf club groupings (not shown) will tend to gather and be held in specific locations within the open segregation areas. More specifically, the golf club groupings (not shown) containable in the right hand open segregation area 44, as viewed in FIG. 2, will gather and stay in the corner formed at the intersection of the downwardly angularly extending divider bar 38 and that arcuate portion of the ring-shaped body 22 which bounds the outer edge of the area 44. Of course, all the clubs can't simultaneously occupy the exact corner position, but they will tend to gather in proximity thereto. For this reason, some of the heads of the golf clubs containable in the open area 44 will hang down over the right hand side of the bottom open area 46 while others will be outside of the ring-shaped body 22 to the right and somewhat above the heads of the golf clubs containable in the bottom open area 46.

The golf club grouping (not shown) containable in the left hand upper area 42 will similarly tend to gather in the corner formed at the intersection of the downwardly angularly extending divider bar 36 and the ring-shaped body 22, and the heads of the golf clubs containable in that area 42 will hang down in a similar manner to that described above with regard to the right hand open area 44.

The golf club grouping containable in the open bottom segregation area 46 will tend to gather and stay substantially centrally on the arcuate portion of the ring-shaped body 22 which defines the bottom edge of this open area 46. The heads of the golf club grouping containable in this open bottom area 46 will hang down and thus not overlay any portion of the bore of the ring-shaped body.

Therefore, the throat structure 18 of the present invention will inherently cause the golf club groupings (not shown) to be carried in widely spaced locations during carrying of the golf bag 10, and this eliminates, or at least substantially reduces, golf club entanglement and thus facilitates golf club insertion and extraction.

As seen in FIG. 2, the center 48 of the junction 40 is spaced below the central axis 50 of the ring-shaped body 22. This preferred location of the junction 40 lowers the center of gravity of the golf bag 10 when it is being carried by placing the corners of the open upper segregation areas 42 and 44, and the golf clubs carried therein, below the central axis 50 of the body 22. By lowering the center of gravity in this manner, carrying of the golf bag 10 will be improved by providing improved stability, i.e., it will resist rolling about the longitudinal axis of the golf bag.

By lowering the junction 40, the angular orientation of the divider bars 34, 36 and 38 should be selected to provide the open segregation areas 42, 44 and 46 with approximately equally sized openings. The specific angles between the divider bars 34, 36 and 38 are not critical. However, excellent golf club group segregation characteristics, and approximately equally sized open segregation areas 42, 44 and 46, result by arranging the divider bars so that an angle of about 105° is included between the divider bars 34 and 36, and between the divider bars 34 and 38. This, of course results in the included angle between the divider bars 36 and 38 being approximately 105°.

As shown, the extending ends of the divider bars 34, 36 and 38 are curved, or flared, at the junctions of those bars with the inner lip 27 of the ring-shaped body 22. And, the inner ends of those divider bars are similarly curved in the area of the junction 40. Therefore, each corner within the entire throat structure 18 has a relatively large radius, and those radii are selected to minimize the catching, or hanging up of the golf clubs when they are being extracted from the golf bag 10. The different corner radii in the throat structure 18 are sized so that they are at least substantially equal to the radius of the largest part of conventional golf club grips (not shown). In this manner, problems of the golf clubs becoming wedgingly caught in the corners of the throat structure 18, and the annular lips of the golf club grips catching in those corners is substantially reduced.

Figure 4:
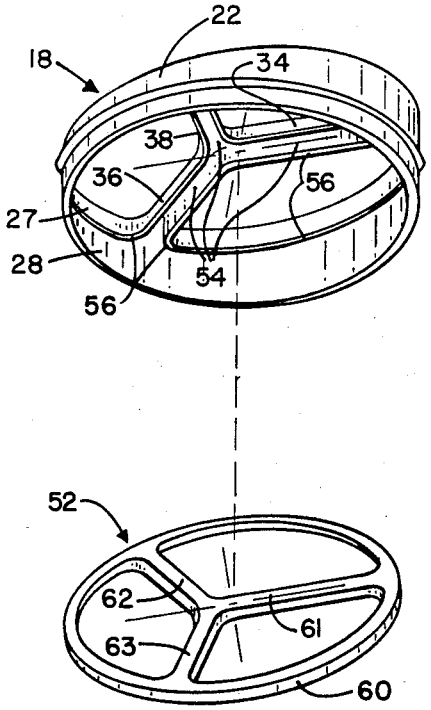
FIG. 4 is a exploded perspective view showing the throat structure of FIGS. 1, 2 and 3, with a plug insert which provides the means for eliminating the downwardly facing edges of the throat structure.

Reference is now made to FIGS. 4, 5, 6 and 7, wherein a modified form of the hereinbefore described throat structure 18 is shown. FIG. 4 shows the throat structure 18 with a plug insert means 52 which, when assembled to the throat structure 18 as will hereinafter be described, provides the modified throat structure **18*a* shown in section in FIG. 5**.

As previously mentioned, the throat structure 18 is preferably molded as a unitary structure from a suitable synthetic resin. This fabrication technique dictates, as is well known in the art, that the throat structure 18 have the previously mentioned downwardly opening annular groove 28 between the ring-shaped body 22 and the concentric lip 27. This same fabrication requirement also forms downwardly opening slots 54 in each of the divider bars 34, 36 and 38. The downwardly opening annular groove 28 and the downwardly opening slots 54 provide a plurality of downwardly facing edges 56 on both the ring-shaped body 22 and the divider bars 34, 36 and 38. These edges 56 are a primary cause of catching, or hanging up of the golf clubs when they are extracted from the golf bag 10. The annular lip formed by the golf club grips (not shown) can catch on those edges, and often do in the prior art throat structures, and in addition to catching, the grips can tear.

The plug insert means 52 is designed to fit into the annular groove 28 and the slots 54 to fill the groove and the slots and present a downwardly curved surface 58 which covers the edges 56. The plug means 52 is, therefore, provided with a peripheral ring-shaped member 60 having divider ribs 61, 62 and 63. The plug means 52 is configured to match the annular groove 28, the slots 54, and the enlarged openings provided below the junction 40 and the areas where the divider bars 34, 36 and 38 intersect the ring-shaped body 22.

Figure 5:
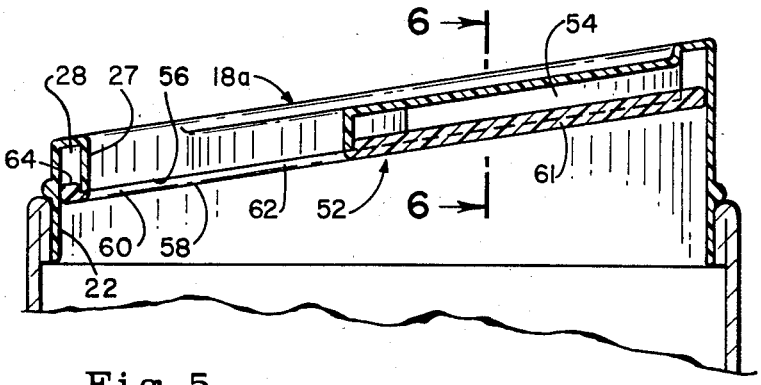
FIG. 5 is a sectional view similar to FIG. 3 and showing the plug insert in the installed position within the throat structure.
Figure 6:
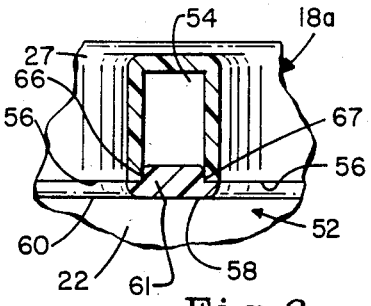
FIG. 6 is an enlarged fragmentary sectional view taken along the line 6—6 of FIG. 5 and showing the cross sectional configuration of the portions of the plug insert which eliminates the downwardly facing edges of the trifurcated divider means of the throat structure.
Figure 7:
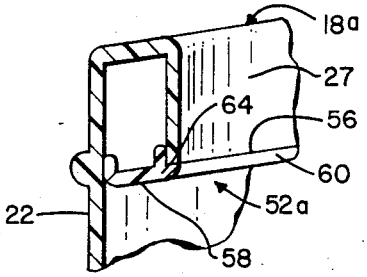
FIG. 7 is a fragmentary sectional view similar to FIG. 5 and showing a modified cross sectional configuration of the plug insert.

As shown in FIG. 5, the ring-shaped member 60 of the plug means has the downwardly facing curved surface 58 and has an upwardly and inwardly opening groove 64 formed therein into which the bottom edge 56 of the concentric lip 27 of the ring-shaped body 22 is received. FIG. 7 shows the cross sectional configuration of the divider ribs 61, 62 and 63 as also having the downwardly facing curved surface 58 thereon and as having a pair of upwardly and laterally opening grooves 66 and 67 into which the bottom edges 56 of the divider bars 34, 36 and 38 are received. As shown, the cross sectional configuration of the various parts of the plug insert means 52 may be solid as shown in FIGS. 5 and 6, or may be of substantially upwardly opening U-shaped configuration as shown in FIG. 7 to provide the modified plug insert means 52*a*.

The plug means 52, or 52*a*, is preferably molded, or otherwise formed of a synthetic resin which is the same as that used in forming the throat structure 18, or is compatable with that material, to allow the throat structure and the plug means to be permanently assembled to each other, such as by employing the well known sonic welding technique.

Figure 8:
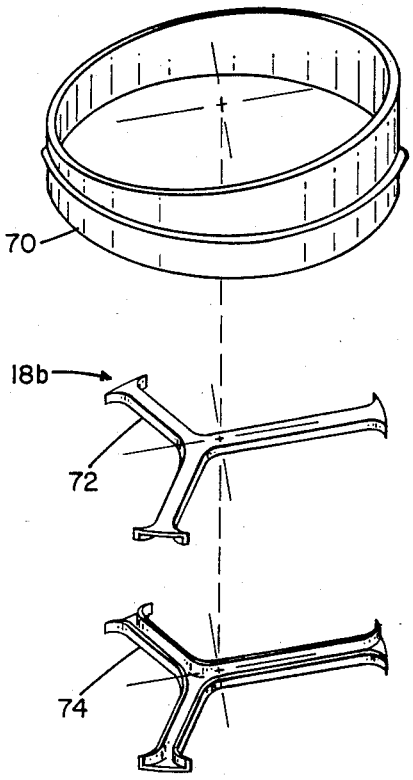
FIG. 8 is a perspective exploded view of a second embodiment of the throat structure of the present invention.
Figure 9:
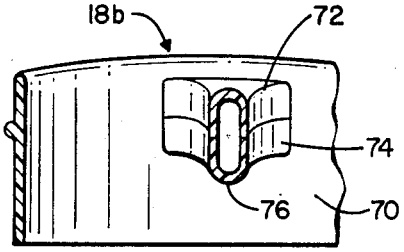
FIG. 9 is a fragmentary sectional view of the throat structure of the second embodiment in the assembled state.

Reference is now made to FIGS. 8 and 9, wherein the second embodiment of the present invention is illustrated. In this embodiment, a ring-shaped body 70 similar to the previously described body 22, is molded or otherwise formed as a separate piece. Likewise, a trifurcated divider means 72, similar to the previously described divider means 32, is also molded, or otherwise formed as a separate piece. The body 70 and the divider means 72 may be assembled, such as by sonic welding as suggested above, to provide a throat structure which is substantially the same as the above described throat structure 18. However, it is preferred that a second trifurcated divider means 74, possibly from the same mold used to form the divider means 72, be inverted as shown in FIG. 8 and the two divider means 72 and 74 attached to each other, again by the suggested sonic welding technique, with the resulting assembly being mounted in the body 70. This, as shown in FIG. 9, will provide this embodiment of the throat structure 18*b* with a downwardly facing curved surface 76 to prevent golf club hang up.

While the principles of the invention have now been made clear in the illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, while the trifurcated divider means fully described above constitute the preferred embodiments, the same objectives could be accomplished by using straps (not shown) such as of leather, which are suitably attached to form the equivalent of the divider bars 34, 36 and 38. The extending ends of such straps could be passed through suitable slots formed in the ring-shaped body and attached thereto by rivets, snaps, buckles, or other fastener means.

The appended claims are therefore intended to cover and embrace any such modifications within the limits only of the true spirit and scope of the invention.

What I claim is:

1. A throat structure for the top end of a golf bag comprising:

(a) a ring-shaped body defining a bore and being of substantially cylindrical configuration and defining a central axis; and (b) a trifurcated divider means in the bore of said body to divide the bore into three separated open golf club segregation areas, said divider means including first, second and third divider bars which extend radially from an interconnecting junction, said junction being offset from the central axis of said ring-shaped body so as to be below the central axis when said throat structure is mounted in a golf bag and the golf bag is in the normal carrying attitude.

2. A throat structure as claimed in claim 1 wherein each adjacent pair of said divider bars defines an obtuse angle therebetween.

3. A throat structure as claimed in claim 1 wherein said first, second and third divider bars of said trifurcated divider means are arranged in the bore of said ring-shaped body so that the three separated open golf club segregation areas are of substantially equal size.

4. A throat structure as claimed in claim 1 wherein said first, second and third divider bars and the interconnecting junction of said trifurcated divider means are formed as integral unitary structure with the junction and the adjacent ends of said firt, second and third divider bars being radiused at the intersections thereof with the radii being approximately equal to the largest radius of a golf club grip.

5. A throat structure as claimed in claim 4 wherein the extending ends of said first, second and third divider bars are flared to form radii at the intersections of those extending ends with said ring-shaped body with the radii so formed being approximately equal to the largest radius of a golf club grip.

6. A throat structure as claimed in claim 1 and further comprising means on said trifurcated divider means for providing a radius on the edges thereof which face into the golf bag when said throat structure is mounted therein.

7. A throat structure as claimed in claim 1 and further comprising means on said ring-shaped body and on said trifurcated divider means for providing a radius on the edges of said ring-shaped body and said trifurcated divider means which face into the golf bag when said throat structure is mounted therein.

8. A throat structure as claimed in claim 1 wherein said ring-shaped body and said trifurcated divider means are formed as an integral unitary structure.

9. A golf bag for carrying golf clubs in segregated groups comprising, in combination:

(a) a golf bag including an elongated tubular container with means for closing the bottom end and having an open top; and (b) a throat structure in the open top of said golf bag, said throat structure including, I. a ring-shaped body defining a bore and having diametrically opposed top and bottom portions when said golf bag is in a normal carrying attitude, II. a trifurcated divider means in the bore of said ring-shaped body for dividing the bore into three separated open golf club segregationn areas, said divider means including first, second and third divider bars which extend radially from an interconnecting junction which is offset from the center of the bore of said ring-shaped body toward the bottom portion thereof.

10. A golf bag as claimed in claim 9 and further comprising means on said trifurcated divider means for providing radiused surfaces on the portions thereof which face into said tubular container of said golf bag.

11. A golf bag as claimed in claim 9 and further comprising means on said ring-shaped body and on said trifurcated divider means for providing radiused surfaces on the portions thereof which face into said tubular container of said golf bag.

12. A golf bag claimed in claim 9 wherein said trifurcated divider means has said first, second and third divider bars arranged relative to each other to form the three separated open golf club segregation areas in approximately equal sizes.

13. A golf bag as claimed in claim 9 wherein said trifurcated divider means comprises:

(a) said first bar extending radially from said junction to the top portion of said ring-shaped body to divide the upper part of the bore thereof into an upper pair of the three open golf club segregation areas with each of said upper pair being on a different side of said first divider bar;

(b) said second divider bar extending radially from said junction to close the bottom end of one of the pair of upper open golf club segregation areas, said second divider bar arranged relative to said first divider bar to define an obtuse included angle therebetween;

(c) said third divider bar extending radially from said junction to close the bottom end of the other one of the pair of upper open golf club segregation areas, said third divider bar arranged relative to said first divider bar to define an obtuse included angle therebetween; and (d) said second and said third divider bars cooperatively closing the upper end of a bottom one of the three open golf club segregation areas and arranged relative to each other to define an obtuse included angle.

14. A golf bag as claimed in claim 13 wherein the included obtuse angle defined by said first divider bar and said second divider bar is substantially equal to the included obtuse angle defined by said divider bar and said third divider bar with those included obtuse angles being smaller than the included obtuse angle defined by said second divider bar and said third divider bar to form the three separated open golf club segregation areas into approximately equal sizes.

15. A golf bag as claimed in claim 14 wherein said first, secoud and said third divider bars and said junction are formed as an integral unitary structure with said junction and the adjacent ends of said first, said second and said third divider bars being radiused at the intersections thereof to provide radii which are approximately equal to the largest radius of a golf club grip.

16. A golf bag as claimed in claim 14 wherein the extending ends of said first, said second and said third divider bars are flared to form radii at the intersections of those extending ends with said ring-shaped body with the radii so formed being approximately equal to the largest radius of a golf club grip.

17. A golf bag for carrying golf clubs in segregated groups comprising in combination:

(a) a golf bag including an elongated tubular container with means for closing the bottom end thereof and having an open top;

(b) a ring-shaped body of substantially cylindrical configuration in the open top of said golf bag and defining a bore, said body having an outer end and an inner end; and (c) a trifurcated divider means in the bore of said body for dividing the bore into three substantially equally sized open golf club segregation areas, said divider means including, I. junction means, II. three divider bars extending radially from said junction means, III. said divider bars and said junction means having cross sectional configurations which are open on the surfaces thereof which face toward the inner end of said ring-shaped body, IV. plug means attached to said divider bars and said junction means for closing and covering the surfaces thereof which face toward the inner end of said ring-shaped body, said plug means having a radiused surface which faces toward the inner end of said ring-shaped body.

18. A golf bag for carrying golf clubs in segregated groups comprising in combination:

(a) a golf bag including an elongated tubular container with means for closing the bottom end thereof and having an open top;

(b) a ring-shaped body of substantially cylindrical configuration in the open top of said golf bag and defining a bore, said body having an outer end and an inner end; and (c) a trifurcated divider means in the bore of said body for dividing the bore into three substantially equally sized open golf club segregation areas, said divider means including, I. a first structure having three divider bars extending radially and integrally from a junction, said first structure presenting curved surfaces which face the outer end of said ring-shaped bodv and opposed open surfaces, II. a second structure which is identical to said first structure and is attached to the open surfaces of said first structure in an inverted position.

19. A golf bag for carrying golf clubs in segregated groups comprising in combination:

(a) a golf bag including an elongated tubular container with means for closing the bottom end thereof and having an open top;

(b) a ring-shaped body of substantially cylindrical configuration in the open top of said golf bag and defining a bore, said ring-shaped body having an inner end and an outer end and having its outer end rolled inwardly to form an inwardly spaced concentric lip in the bore thereof;

(c) a trifurcated divider means in the bore of said body for dividing the bore into three substantially equally sized open golf club segregation areas, said trifurcated divider means being in the form of an integral structure having three divider bars extending radially from a junction to the concentric lip of said ring-shaped body, said integral structure configured to provide curved surfaces which face the outer end of said ring-shaped body and open surfaces which face the inner end thereof; and (d) plug means attached to the concentric lip of said ring-shaped body and to the open surfaces of said trifurcated divider means, said plug means being configured to present curved surfaces on the portions thereof which face the inner end of said ring-shaped body.

* * * * *